US007445567B2

(12) United States Patent
Watanabe

(10) Patent No.: US 7,445,567 B2
(45) Date of Patent: Nov. 4, 2008

(54) MULTI-PIECE SOLID GOLF BALL

(75) Inventor: Hideo Watanabe, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 11/637,838

(22) Filed: Dec. 13, 2006

(65) Prior Publication Data

US 2008/0146376 A1 Jun. 19, 2008

(51) Int. Cl.
*A63B 37/06* (2006.01)

(52) U.S. Cl. ..... 473/376

(58) Field of Classification Search ..... 473/376, 473/371, 373, 374
See application file for complete search history.

(56) References Cited

U.S. PATENT DOCUMENTS

| | | | | |
|---|---|---|---|---|
| 5,772,531 | A | 6/1998 | Ohsumi et al. | |
| 5,816,937 | A | 10/1998 | Shimosaka et al. | |
| 5,980,396 | A | 11/1999 | Moriyama et al. | |
| 6,045,460 | A | 4/2000 | Hayashi et al. | |
| 6,123,630 | A | 9/2000 | Hayashi et al. | |
| 6,152,834 | A | 11/2000 | Sullivan | |
| 6,194,505 | B1 | 2/2001 | Sone et al. | |
| 6,231,461 | B1 | 5/2001 | Moriyama et al. | |
| 6,248,027 | B1 | 6/2001 | Hayashi et al. | |
| 6,394,914 | B1 | 5/2002 | Sullivan | |
| 6,419,595 | B1 * | 7/2002 | Maruko et al. | 473/376 |
| 6,468,169 | B1 | 10/2002 | Hayashi et al. | |
| 6,527,652 | B1 * | 3/2003 | Maruko et al. | 473/371 |
| 6,642,314 | B2 | 11/2003 | Sone et al. | |
| 6,663,507 | B1 | 12/2003 | Watanabe et al. | |
| 6,702,694 | B1 | 3/2004 | Watanabe | |
| 6,814,676 | B2 | 11/2004 | Watanabe et al. | |
| 6,899,641 | B2 | 5/2005 | Watanabe | |
| 6,981,925 | B2 | 1/2006 | Shimizu et al. | |
| 2003/0083155 | A1 * | 5/2003 | Endo et al. | 473/371 |
| 2004/0106474 | A1 * | 6/2004 | Hayashi et al. | 473/371 |

(Continued)

FOREIGN PATENT DOCUMENTS

JP 9-248351 A 9/1997

(Continued)

*Primary Examiner*—Raeann Trimiew
(74) *Attorney, Agent, or Firm*—Sughrue Mion, PLLC

(57) ABSTRACT

The invention provides a multi-piece solid golf ball having a core, an envelope layer which encases the core and is composed of an inside layer and an outside layer, an intermediate layer encasing the envelope layer, and a cover which encases the intermediate layer and has formed on a surface thereof a plurality of dimples. The core is formed primarily of a rubber material, and the envelope layer, intermediate layer and cover are each formed primarily of the same or different resin materials. The envelope layer, intermediate layer and cover have thicknesses which satisfy the relationship: cover thickness<intermediate layer thickness<envelope layer total thickness. The envelope layer, intermediate layer and cover have material hardnesses (Durometer D hardness) which satisfy the relationship: hardness of envelope inside layer material<hardness of envelope outside layer material<hardness of intermediate layer material>hardness of cover material. The envelope outside layer material has a Durometer D hardness of at least 53. The golf ball of the invention has an excellent flight and controllability which are acceptable to professional and skilled amateur golfers, and also has an excellent durability to cracking on repeated impact and an excellent scuff resistance.

23 Claims, 1 Drawing Sheet

U.S. PATENT DOCUMENTS

2004/0147694 A1 7/2004 Sone et al.

FOREIGN PATENT DOCUMENTS

| | | | |
|---|---|---|---|
| JP | 10-127818 | A | 5/1998 |
| JP | 10-127819 | A | 5/1998 |
| JP | 10-295852 | A | 11/1998 |
| JP | 10-328325 | A | 12/1998 |
| JP | 10-328326 | A | 12/1998 |
| JP | 10-328327 | A | 12/1998 |
| JP | 10-328328 | A | 12/1998 |
| JP | 11-4916 | A | 1/1999 |
| JP | 11-35633 | A | 2/1999 |
| JP | 11-164912 | A | 6/1999 |
| JP | 2001-17569 | A | 1/2001 |
| JP | 2001-37914 | A | 2/2001 |
| JP | 2002-293996 | A | 10/2002 |
| JP | 2003-190330 | A | 7/2003 |
| JP | 2004-49913 | A | 2/2004 |
| JP | 2004-97802 | A | 4/2004 |
| JP | 2005-319287 | A | 11/2005 |

* cited by examiner

MULTI-PIECE SOLID GOLF BALL

BACKGROUND OF THE INVENTION

The present invention relates to a multi-piece solid golf ball composed of a core, a plurality of envelope layers, an intermediate layer and a cover that have been formed as successive layers. More specifically, the invention relates to a multi-piece solid golf ball which has a flight performance and controllability that satisfy the needs of professionals and other skilled golfers, and which also has a good feel on impact and an excellent scuff resistance.

A variety of golf balls have hitherto been developed for professionals and other skilled golfers. Of these, multi-piece solid golf balls having an optimized hardness relationship between an intermediate layer encasing the core and the cover layer are in wide use because they achieve both a superior distance in the high head speed range and good controllability on shots taken with an iron and on approach shots. Another important concern is the proper selection of thicknesses and hardnesses for the respective layers of the golf ball so as to optimize not only flight performance, but also both the feel of the ball when played as well as its spin rate after being struck with the club, particularly given the large influence these latter factors have on ball control. A further key concern in ball development, arising from the desire that golf balls also have durability under repeated impact and scuff resistance against burr formation on the surface of the ball when repeatedly played with different types of clubs, is how best to protect the ball from external factors.

The three-piece solid golf balls having an outer layer cover formed primarily of a thermoplastic polyurethane which are disclosed in, for example, JP-A 2003-190330, JP-A 2004-49913, JP-A 2004-97802 and JP-A 2005-319287 were intended to meet such needs. However, because these prior-art golf balls fail to achieve a sufficiently lower spin rate when hit with a driver, professionals and other skilled golfers have desired a ball which delivers an even longer distance.

Meanwhile, efforts to improve the flight and other performance characteristics of golf balls have led to the development of balls having a four-layer construction—i.e., a core enclosed by three intermediate or cover layers—that allows the ball construction to be varied among the several layers at the interior. Such golf balls have been disclosed in, for example, JP-A 9-248351, JP-A 10-127818, JP-A 10-127819, JP-A 10-295852, JP-A 10-328325, JP-A 10-328326, JP-A 10-328327, JP-A 10-328328 and JP-A 11-4916.

Yet, as golf balls for the skilled golfer, such balls provide a poor balance of distance and controllability or they fall short in terms of achieving a lower spin rate on shots with a driver, thus limiting the extent to which the total distance can be increased.

Multilayer golf balls having a core and a four-layer cover have been disclosed in, for example, JP-A 2001-17569, U.S. Pat. No. 6,416,425 and JP-A 2001-37914. Efforts have been made to improve overall the ball performance by optimizing such properties of these multilayer balls as their core deflection (deformation) and the hardnesses of the respective covers.

However, these latter multilayer golf balls too leave something to be desired as golf balls for the skilled golfer in terms of one or more of the following attributes: distance, controllability, feel on impact, durability to repeated impact, and scuff resistance.

SUMMARY OF THE INVENTION

It is therefore an object of the present invention to provide a multi-piece solid golf ball which has a flight performance and controllability that are fully acceptable to professionals and other skilled golfers, while also having an excellent durability to cracking on repeated impact and an excellent scuff resistance.

In the present invention, the golf ball design consists basically of an outermost layer made of polyurethane and a multilayer structure of four or more outer layers (two-part envelope layer composed of an inside layer and an outside layer/intermediate layer/cover) encasing the core. By being produced in such a way that the cover (outermost layer) is softer than the intermediate layer, the ball is provided with a spin performance on approach shots that is acceptable to professionals and other skilled golfers and with a high scuff resistance. Moreover, of the four layers encasing the core, by having the intermediate layer made of the hardest material, the ball can be provided with a high rebound and an excellent durability, in addition to which the spin rate of the ball on full shots can be lowered. In addition, by selecting the materials making up the layers so that the surfaces of the respective layers in the envelope inside layer/envelope outside layer/intermediate layer construction become progressively harder toward the outside of the ball, and also optimizing the envelope layer/intermediate layer/cover layer thickness relationship, it was possible through the synergistic effects of these hardness relationships and layer thickness relationships to resolve the above-described problems encountered in the prior art. That is, the golf ball of the invention, when used by professionals and other skilled golfers, provides a fully acceptable flight performance and controllability, in addition to which it exhibits an excellent durability to cracking on repeated impact and excellent scuff resistance, effects which were entirely unanticipated. Having thus found that the technical challenges recited above can be overcome by the foregoing arrangement, the inventors ultimately arrived at the present invention.

Accordingly, the invention provides the following multi-piece solid golf balls.

[1] A multi-piece solid golf ball comprising a core, an envelope layer which encases the core and comprises an inside layer and an outside layer, an intermediate layer encasing the envelope layer, and a cover which encases the intermediate layer and has formed on a surface thereof a plurality of dimples, wherein the core is formed primarily of a rubber material, the envelope layer, intermediate layer and cover are each formed primarily of the same or different resin materials; the envelope layer, intermediate layer and cover have thicknesses which satisfy the relationship:

cover thickness<intermediate layer thickness<envelope layer total thickness;

the envelope layer, intermediate layer and cover have material hardnesses (Durometer D hardness) which satisfy the relationship:

hardness of envelope inside layer material<hardness of envelope outside layer material<hardness of intermediate layer material>hardness of cover material; and the envelope outside layer material has a Durometer D hardness of at least 53.

[2] The multi-piece solid golf ball of [1], wherein the resin material of the envelope inside layer and/or the envelope outside layer is a material comprising, in admixture:

a base resin of (a) an olefin-unsaturated carboxylic acid random copolymer and/or a metal ion neutralization product of an olefin-unsaturated carboxylic acid random copolymer mixed with (b) an olefin-unsaturated carboxylic acid-unsaturated carboxylic acid ester ternary random copolymer and/or a metal ion neutralization product of an olefin-unsaturated carboxylic acid-unsaturated carboxylic acid ester ternary random copolymer in a weight ratio between 100:0 and 0:100, and (e) a non-ionomeric thermoplastic elastomer in a weight ratio between 100:0 and 50:50.

[3] The multi-piece solid golf ball of [1], wherein the resin material of the envelope inside layer and/or the envelope outside layer is a material comprising:

100 parts by weight of a resin component composed of, in admixture, a base resin of (a) an olefin-unsaturated carboxylic acid random copolymer and/or a metal ion neutralization product of an olefin-unsaturated carboxylic acid random copolymer mixed with (b) an olefin-unsaturated carboxylic acid-unsaturated carboxylic acid ester ternary random copolymer and/or a metal ion neutralization product of an olefin-unsaturated carboxylic acid-unsaturated carboxylic acid ester ternary random copolymer in a weight ratio between 100:0 and 0:100, and (e) a non-ionomeric thermoplastic elastomer in a weight ratio between 100:0 and 50:50;

(c) 5 to 80 parts by weight of a fatty acid and/or fatty acid derivative having a molecular weight of 228 to 1500; and (d) 0.1 to 10 parts by weight of a basic inorganic metal compound capable of neutralizing un-neutralized acid groups in the base resin and component (c).

[4] The multi-piece solid golf ball of [1], wherein the resin material of the outermost layer cover is a material composed primarily of a heated mixture of:

(A) a thermoplastic polyurethane material, and (B) an isocyanate mixture of (b-1) an isocyanate compound having at least two isocyanate groups as functional groups per molecule, dispersed in (b-2) a thermoplastic resin which is substantially non-reactive with isocyanate.

BRIEF DESCRIPTION OF THE DIAGRAMS

DETAILED DESCRIPTION OF THE INVENTION

Figure 1:
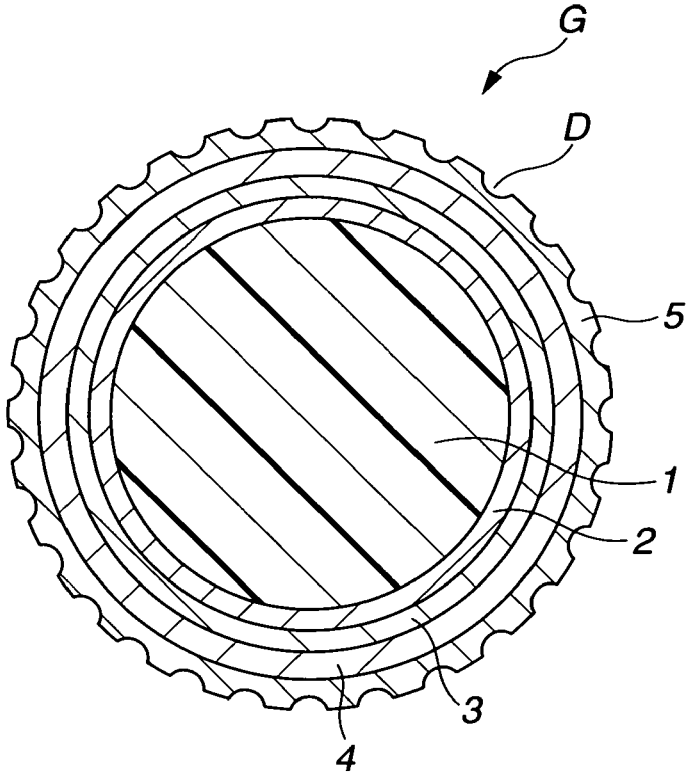
FIG. 1 is a schematic sectional view showing a multi-piece solid golf ball (5-layer construction) according to the invention.

The invention is described more fully below. The multi-piece solid golf ball of the present invention has a multilayer structure composed of a core enclosed by a plurality of layers. That as, as shown in FIG. 1, the inventive golf ball G has four or more layers, including a core 1, a two-part envelope layer composed of an inside layer 2 and an outside layer 3 which encases the core, an intermediate layer 4 which encases the envelope layer, and a cover 5 which encases the intermediate layer. The cover 5 typically has a large number of dimples D formed on the surface thereof. The core 1 and the intermediate layer 4 are not limited to single layers, and may respectively be formed of a plurality of two more layers.

In the invention, the core diameter, while not subject to any particular limitation, is formed generally to at least 31 mm, and is preferably at least 31 mm but not more than 38 mm, more preferably at least 32.5 mm but not more than 37 mm, and even more preferably at least 34 mm but not more than 36 mm. A core diameter outside this range may lower the initial velocity of the ball or yield a less than adequate spin rate-lowering effect after the ball is hit, as a result of which an increased distance may not be achieved.

The surface hardness of the core, while not subject to any particular limitation, preferably has a Durometer D hardness (the value measured with a type D durometer based on ASTM D2240; the same applies to the hardnesses described below for the respective layers) of at least 45 but not more than 65, more preferably at least 50 but not more than 60, and even more preferably at least 52 but not more than 58. Below the above range, the rebound of the core may be inadequate, as a result of which an increased distance may not be achieved, and the durability to cracking on repeated impact may worsen. Conversely, at a core surface hardness higher than the above range, the ball may have an excessively hard feel on full shots with a driver and the spin rate may be too high, as a result of which an increased distance may not be achieved.

The deflection when the core is subjected to loading, i.e., the deflection of the core when compressed under a final load of 1,275 N (130 kgf) from an initial load of 98 N (10 kgf), while not subject to any particular limitation, is preferably set within a range of at least 2.0 mm but not more than 5.0 mm, more preferably at least 2.3 mm but not more than 4.4 mm, and even more preferably at least 2.6 mm but not more than 3.8 mm. If this value is too low, the core may lack sufficient rebound, which may result in a less than adequate distance, or the durability of the ball to cracking on repeated impact may worsen. On the other hand, if this value is too high, the ball may have an excessively hard feel on full shots with a driver, and the spin rate may be too high, as a result of which an increased distance may not be achieved.

A material composed primarily of rubber may be used to form the core having the above-described surface hardness and deflection. For example, the core may be formed of a rubber composition containing, in addition to the rubber component, a co-crosslinking agent, an organic peroxide, an inert filler, an organosulfur compound and the like. It is preferable to use polybutadiene as the base rubber of this rubber composition.

It is desirable for the polybutadiene serving as the rubber component to have a cis-1,4-bond content on the polymer chain of at least 60 wt %, preferably at least 80 wt %, more preferably at least 90 wt %, and most preferably at least 95 wt %. Too low a cis-1,4-bond content among the bonds on the molecule may lead to a lower resilience.

Moreover, the polybutadiene has a 1,2-vinyl bond content on the polymer chain of typically not more than 2%, preferably not more than 1.7%, and even more preferably not more than 1.5%. Too high a 1,2-vinyl bond content may lead to a lower resilience.

To obtain a molded and vulcanized rubber composition of good resilience, the polybutadiene used in the invention is preferably one synthesized with a rare-earth catalyst or a Group VIII metal compound catalyst. Polybutadiene synthesized with a rare-earth catalyst is especially preferred.

Such rare-earth catalysts are not subject to any particular limitation. Exemplary rare-earth catalysts include those made up of a combination of a lanthanide series rare-earth compound with an organoaluminum compound, an alumoxane, a halogen-bearing compound and an optional Lewis base.

Examples of suitable lanthanide series rare-earth compounds include halides, carboxylates, alcoholates, thioalcoholates and amides of atomic number 57 to 71 metals.

In the practice of the invention, the use of a neodymium catalyst in which a neodymium compound serves as the lanthanide series rare-earth compound is particularly advantageous because it enables a polybutadiene rubber having a high cis-1,4 bond content and a low 1,2-vinyl bond content to be obtained at an excellent polymerization activity. Suitable examples of such rare-earth catalysts include those mentioned in JP-A 11-35633, JP-A 11-164912 and JP-A 2002-293996.

To enhance the resilience, it is preferable for the polybutadiene synthesized using the lanthanide series rare-earth compound catalyst to account for at least 10 wt %, preferably at least 20 wt %, and more preferably at least 40 wt %, of the rubber components.

Rubber components other than the above-described polybutadiene may be included in the base rubber, insofar as the objects of the invention are attainable. Illustrative examples of rubber components other than the above-described polybutadiene include other polybutadienes, and other diene rubbers, such as styrene-butadiene rubber, natural rubber, isoprene rubber and ethylene-propylene-diene rubber.

Examples of co-crosslinking agents include unsaturated carboxylic acids and the metal salts of unsaturated carboxylic acids.

Specific examples of unsaturated carboxylic acids include acrylic acid, methacrylic acid, maleic acid and fumaric acid. Acrylic acid and methacrylic acid are especially preferred.

The metal salts of unsaturated carboxylic acids, while not subject to any particular limitation, are exemplified by the above-mentioned unsaturated carboxylic acids neutralized with a desired metal ion. Specific examples include the zinc and magnesium salts of methacrylic acid and acrylic acid. The use of zinc acrylate is especially preferred.

The unsaturated carboxylic acid and/or metal salt thereof is included in an amount, per 100 parts by weight of the base rubber, of generally at least 10 parts by weight, preferably at least 15 parts by weight, and more preferably at least 20 parts by weight, but generally not more than 60 parts by weight, preferably not more than 50 parts by weight, more preferably not more than 45 parts by weight, and most preferably not more than 40 parts by weight. Too much may make the core too hard, giving the ball an unpleasant feel on impact, whereas too little may lower the rebound.

The organic peroxide may be a commercially available product, suitable examples of which include Percumyl D (produced by NOF Corporation), Perhexa 3M and Perhexa C-40 (NOF Corporation), and Luperco 231XL (Atochem Co.). These may be used singly or as a combination of two or more thereof.

The amount of organic peroxide included per 100 parts by weight of the base rubber is generally at least 0.1 part by weight, preferably at least 0.3 part by weight, more preferably at least 0.5 part by weight, and most preferably at least 0.7 part by weight, but generally not more than 5 parts by weight, preferably not more than 4 parts by weight, more preferably not more than 3 parts by weight, and most preferably not more than 2 parts by weight. Too much or too little organic peroxide may make it impossible to achieve a ball having a good feel on impact, durability and rebound.

Examples of suitable inert fillers include zinc oxide, barium sulfate and calcium carbonate. These may be used singly or as a combination of two or more thereof.

The amount of inert filler included per 100 parts by weight of the base rubber is generally at least 1 part by weight, and preferably at least 5 parts by weight, but generally not more than 50 parts by weight, preferably not more than 40 parts by weight, and more preferably not more than 30 parts by weight. Too much or too little inert filler may make it impossible to achieve a proper weight and a good rebound.

In addition, an antioxidant may be included if necessary. Illustrative examples of suitable commercial antioxidants include Nocrac NS-6, Nocrac NS-30 (both available from Ouchi Shinko Chemical Industry Co., Ltd.), and Yoshinox 425 (available from Yoshitomi Pharmaceutical Industries, Ltd.). These may be used singly or as a combination of two or more thereof.

The amount of antioxidant included per 100 parts by weight of the base rubber is generally 0 or more part by weight, preferably at least 0.05 part by weight, and more preferably at least 0.1 part by weight, but generally not more than 3 parts by weight, preferably not more than 2 parts by weight, more preferably not more than 1 part by weight, and most preferably not more than 0.5 part by weight. Too much or too little antioxidant may make it impossible to achieve a good rebound and durability.

To enhance the rebound of the golf ball and increase its initial velocity, it is preferable to include within the core an organosulfur compound.

No particular limitation is imposed on the organosulfur compound, provided it improves the rebound of the golf ball. Exemplary organosulfur compounds include thiophenols, thionaphthols, halogenated thiophenols, and metal salts thereof. Specific examples include pentachlorothiophenol, pentafluorothiophenol, pentabromothiophenol, p-chlorothiophenol, the zinc salt of pentachlorothiophenol, the zinc salt of pentafluorothiophenol, the zinc salt of pentabromothiophenol, the zinc salt of p-chlorothiophenol; and diphenylpolysulfides, dibenzylpolysulfides, dibenzoylpolysulfides, dibenzothiazoylpolysulfides and dithiobenzoylpolysulfides having 2 to 4 sulfurs. The zinc salt of pentachlorothiophenol is especially preferred.

It is recommended that the amount of the organosulfur compound included per 100 parts by weight of the base rubber be generally at least 0.05 part by weight, and preferably at least 0.1 part by weight, but generally not more than 5 parts by weight, preferably not more than 4 parts by weight, more preferably not more than 3 parts by weight, and most preferably not more than 2.5 parts by weight. If too much organosulfur compound is included, the effects of addition may peak so that further addition has no apparent effect, whereas the use of too little organosulfur compound may fail to confer the effects of such addition to a sufficient degree.

In the present invention, an envelope layer, itself composed of two layers—an inside layer and an outside layer, is placed around the above-described core. FIG. 1 shows the inside layer 2 and the outside layer 3 of the envelope layer. This two-part envelope layer is described below.

The material of which the envelope inside layer (referred to below simply as the "inside layer") is made has a hardness which, while not subject to any particular limitation, is preferably at least 45 but not more than 67, more preferably at least 50 but not more than 65, and even more preferably at least 54 but not more than 60. If the envelope layer material is softer than the above range, the ball may have too much spin receptivity on full shots, as a result of which an increased distance may not be achieved. On the other hand, if this material is harder than the above range, the durability of the ball to cracking under repeated impact may worsen and the ball may have too hard a feel when played. It is critical here that the inside layer be softer than the envelope outside layer (referred to below simply as the "outside layer") which directly encases it. The degree to which the hardness of the inside layer is made lower than that of the outside layer, in terms of Durometer D hardness units, is preferably in a range of 1 to 10, and more preferably in a range of 2 to 6. At an inside layer hardness lower than this range, the rebound of the ball may decrease and the spin rate may rise excessively, as a result of which the desired distance may not be achieved.

The inside layer has a thickness which, while not subject to any particular limitation, is preferably at least 0.1 mm but not more than 5 mm, more preferably at least 0.4 mm but not more than 2 mm, and more preferably at least 0.6 mm but not more than 1 mm. Outside of this range, the spin rate-lowering effect on shots with a driver may be insufficient and the ball may have too low a rebound, as a result of which the desired distance may not be achieved.

The material of which the envelope outside layer is made must have a Durometer D hardness of at least 53, the reason being that it is critical to optimize the hardness of the outside layer in order to keep the ball from being too receptive to spin on full shots. Moreover, it is recommended that the outside layer material have a Durometer D hardness of at least 53 but not more than 70, more preferably at least 55 but not more than 67, and even more preferably at least 57 but not more than 63. If the outside layer is softer than the above range, the ball may take on too much spin on full shots, as a result of which an increase in distance may not be achieved. Conversely, if the outside layer is harder than the above range, the durability to cracking under repeated impact may worsen and the feel on impact may become too hard. Although, as noted above, the envelope outside layer is formed so as to be harder than the envelope inside layer, it is essential for it to be softer than the intermediate layer which covers the outside layer. The hardness difference between the envelope outside layer and the intermediate layer, expressed in terms of Durometer D hardness units, is preferably within a range of from 1 to 10, and more preferably from 2 to 5. If the outside layer is softer than the above range, the ball rebound may be low and the spin rate may rise excessively, as a result of which a sufficient distance may not be achieved.

The outside layer has a thickness which, while not subject to any particular limitation, is preferably at least 0.1 mm but not more than 5 mm, more preferably at least 0.4 mm but not more than 2 mm, and even more preferably at least 0.6 mm but not more than 1 mm. Outside of this range, the spin rate-lowering effect on shots with a driver may be insufficient, as a result of which the desired distance may not be achieved.

In the envelope layer of the invention, the inside layer and the outside layer are each composed chiefly of a resin material. The materials used in the inside layer and the outside layer may be resin materials of mutually the same type or different types. Such a resin material, while not subject to any particular limitation, is preferably one which includes as an essential component a base resin of (a) an olefin-unsaturated carboxylic acid random copolymer and/or a metal ion neutralization product of an olefin-unsaturated carboxylic acid random copolymer mixed in a specific ratio with (b) an olefin-unsaturated carboxylic acid-unsaturated carboxylic acid ester ternary random copolymer and/or a metal ion neutralization product of an olefin-unsaturated carboxylic acid-unsaturated carboxylic acid ester ternary random copolymer.

The olefin in the above base resin, for either component (a) or component (b), has a number of carbons which is generally at least 2 but not more than 8, and preferably not more than 6. Specific examples include ethylene, propylene, butene, pentene, hexene, heptene and octene. Ethylene is especially preferred.

Examples of unsaturated carboxylic acids include acrylic acid, methacrylic acid, maleic acid and fumaric acid. Acrylic acid and methacrylic acid are especially preferred.

Moreover, the unsaturated carboxylic acid ester is preferably a lower alkyl ester of the above unsaturated carboxylic acid. Specific examples include methyl methacrylate, ethyl methacrylate, propyl methacrylate, butyl methacrylate, methyl acrylate, ethyl acrylate, propyl acrylate and butyl acrylate. Butyl acrylate (n-butyl acrylate, i-butyl acrylate) is especially preferred.

The olefin-unsaturated carboxylic acid random copolymer of component (a) and the olefin-unsaturated carboxylic acid-unsaturated carboxylic acid ester ternary random copolymer of component (b) (the copolymers in components (a) and (b) are referred to collectively below as "the random copolymers") can each be obtained by preparing the above-mentioned materials and carrying out random copolymerization by a known method.

It is recommended that the above random copolymers have controlled contents of unsaturated carboxylic acid (acid contents). Here, it is recommended that the content of unsaturated carboxylic acid present in the random copolymer serving as component (a) be generally at least 4 wt %, preferably at least 6 wt %, more preferably at least 8 wt %, and even more preferably at least 10 wt %, but not more than 30 wt %, preferably not more than 20 wt %, more preferably not more than 18 wt %, and even more preferably not more than 15 wt %.

Similarly, it is recommended that the content of unsaturated carboxylic acid present in the random copolymer serving as component (b) be generally at least 4 wt %, preferably at least 6 wt %, and more preferably at least 8 wt %, but not more than 15 wt %, preferably not more than 12 wt %, and even more preferably not more than 10 wt %. If the acid content of the random copolymer is too low, the rebound may decrease, whereas if it is too high, the processability of the resin material may decrease.

The metal ion neutralization product of an olefin-unsaturated carboxylic acid random copolymer of component (a) and the metal ion neutralization product of an olefin-unsaturated carboxylic acid-unsaturated carboxylic acid ester ternary random copolymer of component (b) (the metal ion neutralization products of the copolymers in components (a) and (b) are referred to collectively below as "the metal ion neutralization products of the random copolymers") can be obtained by neutralizing some of the acid groups on the random copolymers with metal ions.

Illustrative examples of metal ions for neutralizing the acid groups include $Na^+$, $K^+$, $Li^+$, $Zn^{++}$, $Cu^{++}$, $Mg^{++}$, $Ca^{++}$, $Co^{++}$, $Ni^{++}$ and $Pb^{++}$. Of these, preferred use can be made of, for example, $Na^+$, $Li^+$, $Zn^{++}$ and $Mg^{++}$. To improve resilience, the use of $Na^+$ is even more preferred.

The above metal ion neutralization products of the random copolymers may be obtained by neutralizing the random copolymers with the foregoing metal ions. For example, use may be made of a method in which neutralization is carried out with a compound such as a formate, acetate, nitrate, carbonate, bicarbonate, oxide, hydroxide or alkoxide of the above-mentioned metal ions. No particular limitation is imposed on the degree of neutralization of the random copolymer by these metal ions.

Sodium ion-neutralized ionomer resins may be suitably used as the above metal ion neutralization products of the random copolymers to increase the melt flow rate of the material. This facilitates adjustment to the subsequently described optimal melt flow rate, enabling the moldability to be improved.

Commercially available products may be used as the base resins of above components (a) and (b). Illustrative examples of the random copolymer in component (a) include Nucrel 1560, Nucrel 1214 and Nucrel 1035 (all products of DuPont-Mitsui Polychemicals Co., Ltd.), and Escor 5200, Escor 5100 and Escor 5000 (all products of ExxonMobil Chemical).

Illustrative examples of the random copolymer in component (b) include Nucrel AN 4311 and Nucrel AN 4318 (both products of DuPont-Mitsui Polychemicals Co., Ltd.), and Escor ATX325, Escor ATX320 and Escor ATX310 (all products of ExxonMobil Chemical).

Illustrative examples of the metal ion neutralization product of the random copolymer in component (a) include Himilan 1554, Himilan 1557, Himilan 1601, Himilan 1605, Himilan 1706 and Himilan AM7311 (all products of DuPont-Mitsui Polychemicals Co., Ltd.), Surlyn 7930 (E.I. DuPont de Nemours & Co.), and Iotek 3110 and Iotek 4200 (both products of ExxonMobil Chemical). Illustrative examples of the metal ion neutralization product of the random copolymer in component (b) include Himilan 1855, Himilan 1856 and Himilan AM7316 (all products of DuPont-Mitsui Polychemicals Co., Ltd.), Surlyn 6320, Surlyn 8320, Surlyn 9320 and Surlyn 8120 (all products of E.I. DuPont de Nemours & Co.), and Iotek 7510 and Iotek 7520 (both products of ExxonMobil Chemical). Sodium-neutralized ionomer resins that are suitable as the metal ion neutralization product of the random copolymer include Himilan 1605, Himilan 1601 and Himilan 1555.

When preparing the above-described base resin, component (a) and component (b) must be admixed in a weight ratio of generally between 100:0 and 0:100, preferably between 100:0 and 25:75, more preferably between 100:0 and 50:50, even more preferably between 100:0 and 75:25, and most preferably 100:0. If too little component (a) is included, the molded material obtained therefrom may have a decreased resilience.

In addition, the processability of the base resin can be further improved by also adjusting the ratio in which the random copolymers and the metal ion neutralization products of the random copolymers are admixed when preparing the base resin as described above. It is recommended that the weight ratio of the random copolymer to the metal ion neutralization product of the random copolymer be generally between 0:100 and 60:40, preferably between 0:100 and 40:60, more preferably between 0:100 and 20:80, and most preferably 0:100. The addition of too much random copolymer may lower the processability during mixing.

In addition, component (e) described below may be added to the base resin of the above resin material. Component (e) is a non-ionomeric thermoplastic elastomer. The purpose of this component is to further improve the feel of the ball on impact and the rebound. Examples include olefin elastomers, styrene elastomers, polyester elastomers, urethane elastomers and polyamide elastomers. To further increase the rebound, it is preferable to use a polyester elastomer or an olefin elastomer. The use of an olefin elastomer composed of a thermoplastic block copolymer which includes crystalline polyethylene blocks as the hard segments is especially preferred.

A commercially available product may be used as component (e). Illustrative examples include Dynaron (JSR Corporation) and the polyester elastomer Hytrel (DuPont-Toray Co., Ltd.).

It is recommended that component (e) be included in an amount, per 100 parts by weight of the base resin of the invention, of generally at least 0 part by weight, and particularly at least 5 parts by weight, preferably at least 10 parts by weight, and more preferably at least 20 parts by weight, but not more than 100 parts by weight, preferably not more than 60 parts by weight, more preferably not more than 50 parts by weight, and even more preferably not more than 40 parts by weight. Too much component (e) will lower the compatibility of the mixture, possibly resulting in a substantial decline in the durability of the golf ball.

Next, component (c) described below may be added to the base resin. Component (c) is a fatty acid or fatty acid derivative having a molecular weight of at least 228 but not more than 1500. Compared with the base resin, this component has a very low molecular weight and, by suitably adjusting the melt viscosity of the mixture, helps in particular to improve the flow properties. Component (c) includes a relatively high content of acid groups (or derivatives), and is capable of suppressing an excessive loss in resilience.

The fatty acid or fatty acid derivative of component (c) has a molecular weight of at least 228, preferably at least 256, more preferably at least 280, and even more preferably at least 300, but not more than 1,500, preferably not more than 1,000, even more preferably not more than 600, and most preferably not more than 500. If the molecular weight is too low, the heat resistance cannot be improved. On the other hand, if the molecular weight is too high, the flow properties cannot be improved.

The fatty acid or fatty acid derivative of component (c) may be an unsaturated fatty acid (or derivative thereof) containing a double bond or triple bond on the alkyl moiety, or it may be a saturated fatty acid (or derivative thereof) in which the bonds on the alkyl moiety are all single bonds. It is recommended that the number of carbons on the molecule be generally at least 18, preferably at least 20, more preferably at least 22, and even more preferably at least 24, but not more than 80, preferably not more than 60, more preferably not more than 40, and even more preferably not more than 30. Too few carbons may make it impossible to improve the heat resistance and may also make the acid group content so high as to diminish the flow-improving effect due to interactions with acid groups present in the base resin. On the other hand, too many carbons increases the molecular weight, as a result of which a distinct flow-improving effect may not appear.

Specific examples of the fatty acid of component (c) include stearic acid, 1,2-hydroxystearic acid, behenic acid, oleic acid, linoleic acid, linolenic acid, arachidic acid and lignoceric acid. Of these, stearic acid, arachidic acid, behenic acid and lignoceric acid are preferred. Behenic acid is especially preferred.

The fatty acid derivative of component (c) is exemplified by metallic soaps in which the proton on the acid group of the fatty acid has been replaced with a metal ion. Examples of the metal ion include $Na^{+}$, $Li^{+}$, $Ca^{++}$, $Mg^{++}$, $Zn^{++}$, $Mn^{++}$, $Al^{+++}$, $Ni^{++}$, $Fe^{++}$, $Fe^{+++}$, $Cu^{++}$, $Sn^{++}$, $Pb^{++}$ and $Co^{++}$. Of these, $Ca^{++}$, $Mg^{++}$ and $Zn^{++}$ are especially preferred.

Specific examples of fatty acid derivatives that may be used as component (c) include magnesium stearate, calcium stearate, zinc stearate, magnesium 1,2-hydroxystearate, calcium 1,2-hydroxystearate, zinc 1,2-hydroxystearate, magnesium arachidate, calcium arachidate, zinc arachidate, magnesium behenate, calcium behenate, zinc behenate, magnesium lignocerate, calcium lignocerate and zinc lignocerate. Of these, magnesium stearate, calcium stearate, zinc stearate, magnesium arachidate, calcium arachidate, zinc arachidate, magnesium behenate, calcium behenate, zinc behenate, magnesium lignocerate, calcium lignocerate and zinc lignocerate are preferred.

Component (d) may be added as a basic inorganic metal compound capable of neutralizing acid groups in the base resin and in component (c). If component (d) is not included, when a metallic soap-modified ionomer resin (e.g., the metallic soap-modified ionomer resins cited in the above-mentioned patent publications) is used alone, the metallic soap and un-neutralized acid groups present on the ionomer resin undergo exchange reactions during mixture under heating, generating a large amount of fatty acid. Because the fatty acid has a low thermal stability and readily vaporizes during molding, it may cause molding defects. Moreover, if the fatty acid thus generated deposits on the surface of the molded material, it may substantially lower paint film adhesion and may have other undesirable effects such as lowering the resilience of the resulting molded material.

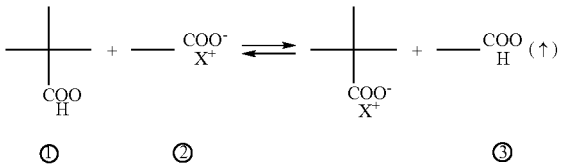

(1) un-neutralized acid group present on the ionomer resin
(2) metallic soap
(3) fatty acid
X: metal cation The inclusion of a basic inorganic metal compound (d) which neutralizes the acid groups present in the base resin and component (c) as an essential component in order to overcome such a problem serves to improve the resilience of the molded material.

That is, by including component (d) as an essential ingredient in the material, not only are the acid groups in the base resin and component (c) neutralized, through synergistic effects from the proper addition of each of these components it is possible as well to increase the thermal stability of the mixture and thus confer a good moldability, and also to enhance the resilience.

Here, it is recommended that the basic inorganic metal compound used as component (d) be a compound having a high reactivity with the base resin and containing no organic acids in the reaction by-products, enabling the degree of neutralization of the mixture to be increased without a loss of thermal stability.

Illustrative examples of the metal ions in the basic inorganic metal compound serving as component (d) include $Li^+$, $Na^+$, $K^+$, $Ca^{++}$, $Mg^{++}$, $Zn^{++}$, $Al^{+++}$, $Ni^{++}$, $Fe^{++}$, $Fe^{+++}$, $Cu^{++}$, $Mn^{++}$, $Sn^{++}$, $Pb^{++}$ and $Co^{++}$. Known basic inorganic fillers containing these metal ions may be used as the basic inorganic metal compound. Specific examples include magnesium oxide, magnesium hydroxide, magnesium carbonate, zinc oxide, sodium hydroxide, sodium carbonate, calcium oxide, calcium hydroxide, lithium hydroxide and lithium carbonate. In particular, a hydroxide or a monoxide is recommended. Calcium hydroxide and magnesium oxide, which have a high reactivity with the base resin, are more preferred. Calcium hydroxide is especially preferred.

Because the above-described resin material is arrived at by blending specific respective amounts of components (c) and (d) with the resin component, i.e., the base resin containing specific respective amounts of components (a) and (b) in combination with optional component (e), this material has excellent thermal stability, flow properties and moldability, and can impart the molded material with a markedly improved resilience.

Components (c) and (d) are included in respective amounts, per 100 parts by weight of the resin component suitably formulated from components (a), (b) and (e), of at least 5 parts by weight, preferably at least 10 parts by weight, more preferably at least 15 parts by weight, and even more preferably at least 18 parts by weight, but not more than 80 parts by weight, preferably not more than 40 parts by weight, more preferably not more than 25 parts by weight, and even more preferably not more than 22 parts by weight, of component (c); and at least 0.1 part by weight, preferably at least 0.5 part by weight, more preferably at least 1 part by weight, and even more preferably at least 2 parts by weight, but not more than 10 parts by weight, preferably not more than 8 parts by weight, more preferably not more than 6 parts by weight, and even more preferably not more than 5 parts by weight, of component (d). Too little component (c) lowers the melt viscosity, resulting in inferior processability, whereas too much lowers the durability. Too little component (d) fails to improve thermal stability and resilience, whereas too much instead lowers the heat resistance of the golf ball-forming material due to the presence of excess basic inorganic metal compound.

In the above-described resin material formulated from the respective above-indicated amounts of the resin component and components (c) and (d), it is recommended that at least 50 mol %, preferably at least 60 mol %, more preferably at least 70 mol %, and even more preferably at least 80 mol %, of the acid groups be neutralized. Such a high degree of neutralization makes it possible to more reliably suppress the exchange reactions that cause trouble when only a base resin and a fatty acid or fatty acid derivative are used as in the above-cited prior art, thus preventing the generation of fatty acid. As a result, there is obtained a resin material of substantially improved thermal stability and good processability which can provide molded products of much better resilience than prior-art ionomer resins.

"Degree of neutralization," as used above, refers to the degree of neutralization of acid groups present within the mixture of the base resin and the fatty acid or fatty acid derivative serving as component (c), and differs from the degree of neutralization of the ionomer resin itself when an ionomer resin is used as the metal ion neutralization product of a random copolymer in the base resin. A mixture according to the invention having a certain degree of neutralization, when compared with an ionomer resin alone having the same degree of neutralization, contains a very large number of metal ions. This large number of metal ions increases the density of ionic crosslinks which contribute to improved resilience, making it possible to confer the molded product with excellent resilience.

To more reliably achieve a material having both a high degree of neutralization and good flow properties, it is recommended that the acid groups in the above-described mixture be neutralized with transition metal ions and with alkali metal and/or alkaline earth metal ions. Although neutralization with transition metal ions provides a weaker ionic cohesion than neutralization with alkali metal and alkaline earth metal ions, the combined use of these different types of ions to neutralize acid groups in the mixture can substantially improve the flow properties.

It is recommended that the molar ratio between the transition metal ions and the alkali metal and/or alkaline earth metal ions be in a range of generally 10:90 to 90:10, preferably 20:80 to 80:20, more preferably 30:70 to 70:30, and most preferably 40:60 to 60:40. Too low a molar ratio of transition metal ions may fail to provide a sufficient flow-improving effect. On the other hand, too high a transition metal ion molar ratio may lower the resilience.

Examples of the metal ions include, but are not limited to, zinc ions as the transition metal ions and at least one type of ion selected from among sodium, lithium and magnesium ions as the alkali metal or alkaline earth metal ions.

A known method may be used to obtain a mixture in which the desired amount of acid groups have been neutralized with transition metal ions and alkali metal or alkaline earth metal ions. Specific examples of methods of neutralization with transition metal ions, particularly zinc ions, include methods which use zinc soaps as the fatty acid derivative, methods which use zinc ion neutralization products (e.g., a zinc ion-neutralized ionomer resin) when formulating components (a) and (b) as the base resin, and methods which use zinc compounds such as zinc oxide as the basic inorganic metal compound of component (d).

The resin material should preferably have a melt flow rate adjusted to ensure flow properties that are particularly suitable for injection molding, and thus improve moldability. Specifically, it is recommended that the melt flow rate (MFR), as measured according to JIS K7210 at a test temperature of 190° C. and under a load of 21.18 N (2.16 kgf), be set to generally at least 0.5 dg/min, preferably at least 1 dg/min, more preferably at least 1.5 dg/min, and even more preferably at least 2 dg/min, but not more than 20 dg/min, preferably not more than 10 dg/min, more preferably not more than 5 dg/min, and even more preferably not more than 3 dg/min. Too high or low a melt flow rate may result in a substantial decline in processability.

Next, the intermediate layer is described.

The material from which the intermediate layer is formed has a hardness, expressed as the Durometer D hardness, which, while not subject to any particular limitation, is preferably at least 50 but not more than 70, more preferably at least 55 but not more than 66, and even more preferably at least 60 but not more than 63. If the intermediate layer material is softer than the above range, the ball may have too much spin receptivity on full shots, as a result of which an increased distance may not be attained. On the other hand, if this material is harder than the above range, the durability of the ball to cracking under repeated impact may worsen and the ball may have too hard a feel when played with a putter or on short approach shots.

Moreover, the intermediate layer material has a hardness which satisfies the following relationship:

hardness of envelope inside layer material<hardness of envelope outside layer material<hardness of intermediate layer material>hardness of cover material.

That is, the intermediate layer is formed so as to be the hardest of the various encasing layers, inclusive of the envelope layers and the cover. This is described more fully later in the specification.

The intermediate layer has a thickness which, while not subject to any particular limitation, is generally at least 0.7 mm but not more than 2.0 mm, preferably at least 0.9 mm but not more than 1.7 mm, and more preferably at least 1.1 mm but not more than 1.4 mm. Outside of this range, the spin rate-lowering effect on shots with a driver (W#1) may be inadequate, as a result of which an increased distance may not be achieved. Moreover, a thickness lower than the above range may worsen the durability to cracking on repeated impact or worsen the low-temperature durability.

The intermediate layer may be formed primarily of a resin material which is the same as or different from the above-described material used to form the envelope layer. An ionomer resin is especially preferred. Specific examples include sodium-neutralized ionomer resins available under the trade name designations Himilan 1605, Himilan 1601 and Surlyn 8120, and zinc-neutralized ionomer resins such as Himilan 1557 and Himilan 1706. These may be used singly or as a combination of two or more thereof.

An embodiment in which the intermediate layer material is composed primarily of, in admixture, both a zinc-neutralized ionomer resin and a sodium-neutralized ionomer resin is especially preferable for attaining the objects of the invention. The mixing ratio, expressed as zinc-neutralized resin/sodium-neutralized resin (weight ratio), is generally from 25/75 to 75/25, preferably from 35/65 to 65/35, and more preferably from 45/55 to 55/45.

Outside of this ratio, the ball rebound may be too low, as a result of which the desired distance may not be achieved, the durability to repeated impact at normal temperatures may worsen, and the durability to cracking at low temperatures (below 0° C.) may worsen.

To increase adhesion between the intermediate layer material and the subsequently described cover, it is desirable to abrade the surface of the intermediate layer. Abrasion treatment is particularly effective when a resin material composed primarily of polyurethane is used as the cover material. In addition, it is preferable to apply a primer (adhesive) to the surface of the intermediate layer following such abrasion or to add an adhesion reinforcing agent to the intermediate layer material. Examples of adhesion reinforcing agents that may be incorporated in the material include organic compounds such as 1,3-butanediol and trimethylolpropane, and oligomers such as polyethylene glycol and polyhydroxy polyolefin oligomers. The use of trimethylolpropane or a polyhydroxy polyolefin oligomer is especially preferred. Examples of commercially available products include trimethylolpropane produced by Mitsubishi Gas Chemical Co., Ltd. and polyhydroxy polyolefin oligomers produced by Mitsubishi Chemical Corporation (under the trade name designation Polytail H; number of main-chain carbons, 150 to 200; with hydroxyl groups at the ends).

The surface hardness of the intermediate layer, and specifically the surface hardness of the sphere composed of the core and envelope layer encased by the intermediate layer, expressed as the Durometer D hardness, while not subject to any particular limitation, is preferably at least 60 but not more than 80, more preferably at least 63 but not more than 77, and even more preferably at least 67 but not more than 73. If the surface hardness is lower than the above range, the ball will tend to take on too much spin on full shots, as a result of which an increased distance may not be achieved. On the other hand, if the surface hardness is greater than the above range, the durability to cracking under repeated impact may worsen and the ball may have an excessively hard feel on shots with a putter or on short approach shots. The surface hardness of this intermediate layer is determined by such factors as the hardnesses of the underlying core and envelope layer and by the thickness of the intermediate layer, and differs from the hardness of the intermediate layer material itself.

Next, the cover is described. As used herein, the term "cover" denotes the outermost layer of the ball construction, and excludes what is referred to herein as the intermediate layer and the envelope layer (both the inside and outside layers).

The cover material has a hardness, expressed as the Durometer D hardness, which, while not subject to any particular limitation, is preferably at least 40 but not more than 60, more preferably at least 43 but nor more than 57, and even more preferably at least 46 but not more than 54. At a hardness below this range, the ball tends to take on too much spin on full shots, as a result of which an increased distance may not be achieved. On the other hand, at a hardness above this range, on approach shots, the ball lacks spin receptivity and thus may have an inadequate controllability even when played by a professional or other skilled golfer.

The thickness of the cover, while not subject to any particular limitation, is preferably at least 0.3 mm but not more than 1.5 mm, more preferably at least 0.5 mm but not more than 1.2 mm, and even more preferably at least 0.7 mm but not more than 1.0 mm. If the cover is thicker than the above range, the ball may have an inadequate rebound on shots with a driver (W#1) or the spin rate may be too high, as a result of which an increased distance may not be achieved. Conversely, if the cover is thinner than the above range, the ball may have a poor scuff resistance and inadequate controllability even when played by a professional or other skilled golfer.

In the practice of the invention, a known resin material is selected as the cover material. It is especially preferable from the standpoint of both controllability and scuff resistance to use a resin material composed primarily of polyurethane. However, the resin material in the cover of the invention is not limited to such a resin material composed primarily of polyurethane.

The polyurethane is not subject to any particular limitation, although from the standpoint of amenability to mass production, it is especially preferable to use a thermoplastic polyurethane. In the practice of the invention, the use of a cover-molding material (C) composed primarily of the following components A and B is advantageous:

(A) a thermoplastic polyurethane material, and (B) an isocyanate mixture obtained by dispersing (b-1) a compound having two or more isocyanate groups as functional groups per molecule in (b-2) a thermoplastic resin which is substantially non-reactive with isocyanate.

Components (A), (B) and (C) are described below.

(A) Thermoplastic Polyurethane Material

The thermoplastic polyurethane material has a morphology which includes soft segments composed of a polymeric polyol (polymeric glycol) and hard segments composed of a chain extender and a diisocyanate. The polymeric polyol used as a starting material may be any that has hitherto been employed in the art relating to thermoplastic polyurethane materials, without particular limitation. Exemplary polymeric polyols include polyester polyols and polyether polyols, although polyether polyols are better than polyester polyols for synthesizing thermoplastic polyurethane materials that provide a high rebound resilience and have excellent low-temperature properties. Suitable polyether polyols include polytetramethylene glycol and polypropylene glycol. Polytetramethylene glycol is especially preferred for achieving a good rebound resilience and good low-temperature properties. The polymeric polyol has an average molecular weight of preferably 1,000 to 5,000. To synthesize a thermoplastic polyurethane material having a high rebound resilience, an average molecular weight of 2,000 to 4,000 is especially preferred.

Preferred chain extenders include those used in the prior art relating to thermoplastic polyurethane materials. Illustrative, non-limiting, examples include 1,4-butylene glycol, 1,2-ethylene glycol, 1,3-butanediol, 1,6-hexanediol, and 2,2-dimethyl-1,3-propanediol. These chain extenders have an average molecular weight of preferably 20 to 15,000.

Diisocyanates suitable for use include those employed in the prior art relating to thermoplastic polyurethane materials. Illustrative, non-limiting, examples include aromatic diisocyanates such as 4,4'-diphenylmethane diisocyanate, 2,4-toluene diisocyanate and 2,6-toluene diisocyanate; and aliphatic diisocyanates such as hexamethylene diisocyanate. Depending on the type of isocyanate used, the crosslinking reaction during injection molding may be difficult to control. In the present invention, to ensure stable reactivity with the subsequently described isocyanate mixture (B), it is most preferable to use an aromatic diisocyanate, and specifically 4,4'-diphenylmethane diisocyanate.

A commercial product may be suitably used as the above-described thermoplastic polyurethane material. Illustrative examples include Pandex T-8290, Pandex T-8295 and Pandex T-8260 (all manufactured by DIC Bayer Polymer, Ltd.), and Resamine 2593 and Resamine 2597 (both manufactured by Dainichi Seika Colour & Chemicals Mfg. Co., Ltd.).

(B) Isocyanate Mixture

The isocyanate mixture (B) is prepared by dispersing (b-1) an isocyanate compound having as functional groups at least two isocyanate groups per molecule in (b-2) a thermoplastic resin that is substantially non-reactive with isocyanate. Above isocyanate compound (b-1) is preferably an isocyanate compound used in the prior art relating to thermoplastic polyurethane materials. Illustrative, non-limiting, examples include aromatic diisocyanates such as 4,4'-diphenylmethane diisocyanate, 2,4-toluene diisocyanate and 2,6-toluene diisocyanate; and aliphatic diisocyanates such as hexamethylene diisocyanate. From the standpoint of reactivity and work safety, the use of 4,4'-diphenylmethane diisocyanate is most preferred.

The thermoplastic resin (b-2) is preferably a resin having a low water absorption and excellent compatibility with thermoplastic polyurethane materials. Illustrative, non-limiting, examples of such resins include polystyrene resins, polyvinyl chloride resins, ABS resins, polycarbonate resins and polyester elastomers (e.g., polyether-ester block copolymers, polyester-ester block copolymers). From the standpoint of rebound resilience and strength, the use of a polyester elastomer, particularly a polyether-ester block copolymer, is especially preferred.

In the isocyanate mixture (B), it is desirable for the relative proportions of the thermoplastic resin (b-2) and the isocyanate compound (b-1), expressed as the weight ratio (b-2):(b-1), to be from 100:5 to 100:100, and especially from 100:10 to 100:40. If the amount of the isocyanate compound (b-1) relative to the thermoplastic resin (b-2) is too small, a greater amount of the isocyanate mixture (B) will have to be added to achieve an amount of addition sufficient for the crosslinking reaction with the thermoplastic polyurethane material (A). As a result, the thermoplastic resin (b-2) will exert a large influence, compromising the physical properties of the cover-molding material (C). On the other hand, if the amount of the isocyanate compound (b-1) relative to the thermoplastic resin (b-2) is too large, the isocyanate compound (b-1) may cause slippage to occur during mixing, making preparation of the isocyanate mixture (B) difficult.

The isocyanate mixture (B) can be obtained by, for example, adding the isocyanate compound (b-1) to the thermoplastic resin (b-2) and thoroughly working together these components at a temperature of 130 to 250° C. using mixing rolls or a Banbury mixer, then either pelletizing or cooling and subsequently grinding. A commercial product such as Crossnate EM30 (made by Dainichi Seika Colour & Chemicals Mfg. Co., Ltd.) may be suitably used as the isocyanate mixture (B).

(C) Cover-Molding Material

The cover-molding material (C) is composed primarily of the above-described thermoplastic polyurethane material (A) and isocyanate mixture (B). The relative proportions of the thermoplastic polyurethane material (A) and the isocyanate mixture (B) in the cover-molding material (C), expressed as the weight ratio A:B, is preferably from 100:1 to 100:100, more preferably from 100:5 to 100:50, and even more preferably from 100:10 to 100:30. If too little isocyanate mixture (B) is included relative to the thermoplastic polyurethane material (A), a sufficient crosslinking effect will not be achieved. On the other hand, if too much is included, unreacted isocyanate may discolor the molded material.

In addition to the above-described ingredients, other ingredients may be included in the cover-molding material (C). For example, thermoplastic polymeric materials other than the thermoplastic polyurethane material may be included; illustrative examples include polyester elastomers, polyamide elastomers, ionomer resins, styrene block elastomers, polyethylene and nylon resins. Thermoplastic polymeric materials other than the thermoplastic polyurethane material may be included in an amount of 0 to 100 parts by weight, preferably 1 to 75 parts by weight, and more preferably 10 to 50 parts by weight, per 100 parts by weight of the thermoplastic polyurethane material serving as the essential component. The amount of such thermoplastic polymeric materials used is selected as appropriate for such purposes as adjusting the hardness of the cover material, improving the rebound, improving the flow properties, and improving adhesion. If necessary, various additives such as pigments, dispersants, antioxidants, light stabilizers, ultraviolet absorbers and parting agents may also be suitably included in the cover-molding material (C).

Formation of the cover from the cover-molding material (C) can be carried out by adding the isocyanate mixture (B) to the thermoplastic polyurethane material (A) and dry mixing, then using an injection molding machine to mold the mixture into a cover over the core. The molding temperature varies with the type of thermoplastic polyurethane material (A), although molding is generally carried out within a temperature range of 150 to 250° C.

Reactions and crosslinking which take place in the golf ball cover obtained as described above are believed to involve the reaction of isocyanate groups with hydroxyl groups remaining on the thermoplastic polyurethane material to form urethane bonds, or the creation of an allophanate or biuret crosslinked form via a reaction involving the addition of isocyanate groups to urethane groups in the thermoplastic polyurethane material. Although the crosslinking reaction has not yet proceeded to a sufficient degree immediately after injection molding of the cover-molding material (C), the crosslinking reaction can be made to proceed further by carrying out an annealing step after molding, in this way maintaining properties useful for a golf ball cover. "Annealing," as used herein, refers to heat aging the cover at a constant temperature for a given length of time, or aging the cover for a fixed period at room temperature.

In addition to the above resin components, various optional additives may be included in the above-described resin materials for the envelope layer (inside layer and outside layer), the intermediate layer and the cover. Such additives include, for example, pigments, dispersants, antioxidants, ultraviolet absorbers, ultraviolet stabilizers, parting agents, plasticizers, and inorganic fillers (e.g., zinc oxide, barium sulfate, titanium dioxide).

Relationship Between Thicknesses of Envelope Layer, Intermediate Layer and Cover In the present invention, it is critical that the following relationship hold among the thicknesses of the above-described envelope layer, intermediate layer and cover: cover thickness<intermediate layer thickness<envelope layer thickness (inside layer thickness+outside layer thickness). By optimizing the thicknesses of these various layers, there can be obtained a golf ball which achieves all of the following: distance, controllability, durability and feel. Should the cover be thicker than the intermediate layer, the ball rebound will decrease or the ball will take on too much spin on full shots, as a result of which an increased distance will not be attainable. Should the envelope layer have a total thickness which is less than the thickness of the intermediate layer, the ball will not have a sufficient spin-lowering effect, as a result of which the desired distance will not be achieved.

Relationship Between Hardnesses of Envelope Layer (Inside Layer and Outside Later) Materials, Intermediate Layer Material and Cover Materials In the practice of the invention, the hardnesses of the respective layers are adjusted so as to satisfy the following relationship:

hardness of envelope inside layer material<hardness of envelope outside layer material<hardness of intermediate layer material>hardness of cover material.

That is, in the golf ball of the invention, the hardest of the layers which enclose the core is the intermediate layer; among the parts of the envelope layer, the outside layer is harder than the inside layer; and the cover serving as the outermost layer is formed so as to be softer than the intermediate layer. By forming the intermediate layer, which is the second from the outside of the four layers that encase the core, as the hardest layer, the spin rate by the ball on full shots is lowered and a high rebound can be obtained, thus making it possible to achieve both the controllability desired by professionals and skilled amateurs as well as a good distance on shots with a driver (W#1).

The multi-piece solid golf ball of the invention can be manufactured using an ordinary process such as a known injection molding process to form on top of one another the respective layers described above—the core, envelope layer, intermediate layer, and cover. For example, a molded and vulcanized article composed primarily of the rubber material may be placed as the core within a particular injection-molding mold, following which the envelope layer material and the intermediate layer material may be injection-molded in this order to give an intermediate spherical body. The spherical body may then be placed within another injection-molding mold and the cover material injection-molded over the spherical body to give a multi-piece golf ball. Alternatively, the cover may be formed as a layer over the intermediate spherical body by, for example, placing two half-cups, molded beforehand as hemispherical shells, around the intermediate spherical body so as to encase it, then molding under applied heat and pressure.

The inventive golf ball has a surface hardness which is determined by the hardness of the material used in each layer, the hardnesses of the respective layers, and the hardness below the surface of the ball. The surface hardness of the ball, in terms of the Durometer D hardness, is generally at least 55 but not more than 70, preferably at least 57 but not more than 68, and more preferably at least 59 but not more than 66. If this hardness is lower than the above range, the ball may take on too much spin, as a result of which an increased distance may not be achieved. On the other hand, if this hardness is higher than the above range, the ball may not be receptive to spin on approach shots, which may result in a less than desirable controllability even for professionals and other skilled golfers.

The surface hardness of the inventive golf ball is made softer than the surface hardness of the intermediate layer by an amount within a Durometer D hardness range of 1 to 10, preferably 2 to 8, and more preferably 3 to 6. At a hardness difference smaller than this range, the ball may lack receptivity to spin on approach shots, resulting in a less than desirable controllability even for professional and other skilled golfers. At a hardness difference larger than the above range, the rebound may be inadequate or the ball may be too receptive to spin on full shots, as a result of which the desired distance may not be achieved.

Numerous dimples may be formed on the surface of the cover. The dimples arranged on the cover surface, while not subject to any particular limitation, number preferably at least 280 but not more than 360, more preferably at least 300 but not more than 350, and even more preferably at least 320 but not more than 340. If the number of dimples is higher than the above range, the ball will tend to have a low trajectory, which may shorten the distance of travel. On the other hand, if the number of dimples is too small, the ball will tend to have a high trajectory, as a result of which an increased distance may not be achieved.

Any one or combination of two or more dimple shapes, including circular shapes, various polygonal shapes, dewdrop shapes and oval shapes, may be suitably used. If circular dimples are used, the diameter of the dimples may be set to at least about 2.5 mm but not more than about 6.5 mm, and the depth may be set to at least 0.08 mm but not more than 0.30 mm.

To fully manifest the aerodynamic characteristics of the dimples, the dimple coverage on the spherical surface of the golf ball, which is the sum of the individual dimple surface areas, each defined by the border of the flat plane circumscribed by the edge of the dimple, expressed as a ratio (SR) with respect to the spherical surface area of the ball were it to be free of dimples, is preferably at least 60% but not more than 90%. Also, to optimize the trajectory of the ball, the value $V_0$ obtained by dividing the spatial volume of each dimple below the flat plane circumscribed by the edge of that dimple by the volume of a cylinder whose base is the flat plane and whose height is the maximum depth of the dimple from the cylinder base is preferably at least 0.35 but not more than 0.80. In addition, the VR value, which is the sum of the volumes of individual dimples formed below flat planes circumscribed by the dimple edges, as a percentage of the volume of the ball sphere were it to have no dimples thereon, is preferably at least 0.6% but not more than 1.0%. Outside of the above ranges for these values, the ball may assume a trajectory that is not conducive to achieving a good distance, as a result of which the ball may fail to travel a sufficient distance when played.

The golf ball of the invention, which can be manufactured so as to conform with the Rules of Golf for competitive play, may be produced to a ball diameter which is of a size that will not pass through a ring having an inside diameter of 42.672 mm, but is not more than 42.80 mm, and to a weight of generally from 45.0 to 45.93 g.

As explained above, by having a construction in which a core is encased by four or more layers and by optimizing the respective thicknesses and hardnesses of the envelope layer (inside layer and outside layer), intermediate layer and cover as described above, the inventive golf ball is highly beneficial for professionals and other skilled golfers because the spin rate of the ball on full shots with a driver is lowered, providing an increased distance of travel and a good controllability, and because the ball has an excellent durability to cracking under repeated impact and an excellent scuff resistance.

EXAMPLES

Examples of the invention and Comparative Examples are given below by way of illustration, and not by way of limitation.

Examples 1 to 3, Comparative Examples 1 to 7

Core Formation

Rubber compositions were formulated as shown in Table 1, then molded and vulcanized under the conditions shown in Table 1 to form cores. In Comparative Example 6, the rubber composition shown in Table 2 was masticated, then used in the unvulcanized state to encase a center core, following which the resulting sphere was molded and vulcanized, thereby forming a rubber envelope layer (single layer) over the core.

TABLE 1

| | | Example | | | Comparative Example | | | | | | |
|---|---|---|---|---|---|---|---|---|---|---|---|
| | | 1 | 2 | 3 | 1 | 2 | 3 | 4 | 5 | 6 | 7 |
| Core formulation | Polybutadiene[1)] | 100 | 100 | 100 | 100 | 100 | 100 | 100 | 100 | 100 | 100 |
| | Zinc acrylate | 39 | 34.8 | 30.6 | 28.5 | 34.8 | 26.6 | 34 | 34 | 26.6 | 31 |
| | Peroxide[2)] | 1.2 | 1.2 | 1.2 | 1.2 | 1.2 | 1.2 | 1.2 | 1.2 | 1.2 | 1.2 |
| | Antioxidant[3)] | 0.1 | 0.1 | 0.1 | 0.1 | 0.1 | 0.1 | 0.1 | 0.1 | 0.1 | 0.1 |
| | Zinc oxide | 26.3 | 27.8 | 29.4 | 70.9 | 30.6 | 31.9 | 32.9 | 29.1 | 20.0 | 22.6 |
| | Zinc salt of pentachlorothiophenol | 2 | 2 | 2 | 0 | 2 | 1 | 1 | 1 | 1 | 0 |
| | Zinc stearate | 5 | 5 | 5 | 0 | 5 | 5 | 5 | 5 | 5 | 0 |
| Vulcanization conditions | Temperature (° C.) | 155 | 155 | 155 | 155 | 155 | 155 | 155 | 155 | 155 | 155 |
| | Time (min) | 15 | 15 | 15 | 15 | 15 | 15 | 15 | 15 | 15 | 15 |

Note:
Numbers in the table indicate parts by weight.

Trade names for some the materials appearing in the table are given below.

| | |
|---|---|
| Polybutadiene: | Available from JSR Corporation under the trade name BR730. Synthesized with a neodymium catalyst. |
| Peroxide: | A mixture of 1,1-di(t-butylperoxy)cyclohexane and silica, available under the trade name Perhexa C-40. |
| Antioxidant: | 2,2'-Methylenebis(4-methyl-6-t-butylphenol), produced by Ouchi Shinko Chemical Industry Co., Ltd. under the trade name Nocrac NS-6. |

TABLE 2

| Envelope layer (single layer) material | | Comparative Example 6 |
|---|---|---|
| Core formulation | Polybutadiene | 100 |
| | Zinc acrylate | 46.6 |
| | Peroxide | 2 |
| | Antioxidant | 0 |
| | Zinc oxide | 11.0 |

TABLE 2-continued

| Envelope layer (single layer) material | | Comparative Example 6 |
|---|---|---|
| | Zinc salt of pentachlorothiophenol | 1.5 |
| | Zinc stearate | 5 |
| Vulcanization conditions | Temperature (° C.) | 155 |
| | Time (min) | 15 |

Note:
Details concerning the above materials are the same as in Table 1.
Numbers in the table indicate parts by weight.

Formation of Envelope Layer, Intermediate Layer and Cover

Figure 2:
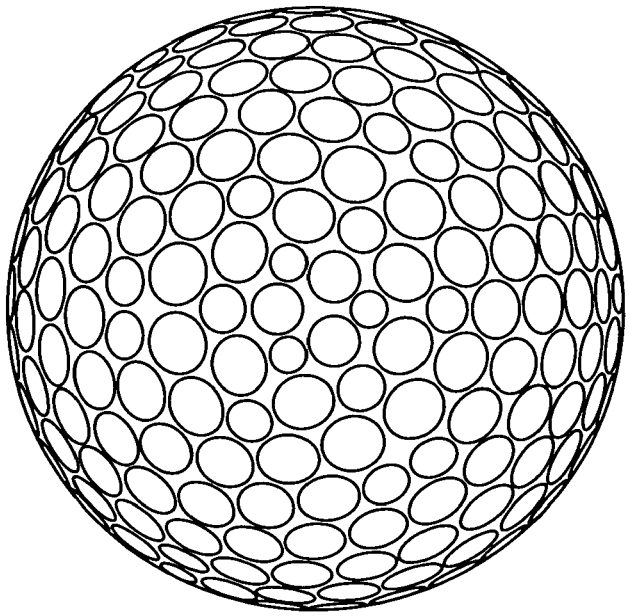
FIG. 2 is a top view of a golf ball showing the arrangement of dimples used in the examples of the invention.

Next, the envelope layer (composed of two layers in the examples according to the invention, and one layer in the comparative examples), intermediate layer and cover formulated from the various resin components shown in Table 3 were injection-molded, thereby forming over the core, in order: an envelope layer composed of either a single layer or two layers, an intermediate layer and a cover. The rubber material described above was used to make the single-layer envelope in Comparative Example 6. Next, using the dimple design in Table 4 and the dimple arrangement pattern shown in FIG. 2, both of which were common to all the examples, dimples were formed on the cover surface, thereby producing multi-piece solid golf balls.

TABLE 3

| Formulation (pbw) | No. 1 | No. 2 | No. 3 | No. 4 | No. 5 | No. 6 | No. 7 |
|---|---|---|---|---|---|---|---|
| Himilan 1605 | 85 | 68.75 | | | 50 | | |
| Himilan 1557 | | | | | 15 | | |
| Himilan 1706 | | | | | 35 | | |
| Himilan 1707 | | | | 100 | | | |
| Surlyn 8120 | | | 75 | | | | |
| Dynaron 6100P | 15 | 31.25 | 25 | | | | |
| Behenic acid | 20 | 18 | 20 | | | | |
| Calcium hydroxide | 2.9 | 2.3 | 2.3 | | | | |
| Calcium stearate | 0.15 | 0.15 | 0.15 | | | | |
| Zinc stearate | 0.15 | 0.15 | 0.15 | | | | |
| Trimethylolpropane | | | | | 1.1 | | |
| Polytail H | | 2 | | | | | |
| Pandex T-8295 | | | | | | 50 | |
| Pandex T-8290 | | | | | | 50 | |
| Pandex T-8260 | | | | | | | 100 |
| Titanium oxide | | | | | | 3.8 | 3.8 |
| Polyethylene wax | | | | | | 1.4 | 1.4 |
| Isocyanate compound | | | | | | 18 | 18 |

Trade names for the chief materials appearing in the above table are given below.

| | |
|---|---|
| Himilan: | Ionomer resins produced by DuPont-Mitsui Polychemicals Co., Ltd. |
| Surlyn: | An ionomer resin produced by E. I. DuPont de Nemours & Co. |
| Dynaron 6100P: | A hydrogenated polymer produced by JSR Corporation. |
| Hytrel: | A polyester elastomer produced by DuPont-Toray Co., Ltd. |
| Behenic acid: | NAA222-S (beads), produced by NOF Corporation. |
| Calcium hydroxide: | CLS-B, produced by Shiraishi Kogyo. |
| Polytail H: | A low-molecular-weight polyolefin polyol produced by Mitsubishi Chemical Corporation. |
| Pandex T-8260, T-8290, T-8295: | MDI-PTMG type thermoplastic polyurethanes produced by DIC Bayer Polymer. |

-continued

| | |
|---|---|
| Polyethylene wax: | Produced by Sanyo Chemical Industries, Ltd. under the trade name Sanwax 161P. |
| Isocyanate compound: | Crossnate EM30 (trade name), an isocyanate masterbatch which is produced by Dainichi Seika Colour & Chemicals Mfg. Co., Ltd., contains 30% of 4,4'-diphenylmethane diisocyanate (measured concentration of amine reverse-titrated isocyanate according to JIS-K1556, 5 to 10%), and in which the masterbatch base resin is a polyester elastomer. The isocyanate compound was mixed with Pandex at the time of injection molding. |

TABLE 4

| No. | Number of dimples | Diameter (mm) | Depth (mm) | $V_0$ | SR | VR |
|---|---|---|---|---|---|---|
| 1 | 12 | 4.6 | 0.15 | 0.47 | 0.81 | 0.783 |
| 2 | 234 | 4.4 | 0.15 | 0.47 | | |
| 3 | 60 | 3.8 | 0.14 | 0.47 | | |
| 4 | 6 | 3.5 | 0.13 | 0.46 | | |
| 5 | 6 | 3.4 | 0.13 | 0.46 | | |
| 6 | 12 | 2.6 | 0.10 | 0.46 | | |
| Total | 330 | | | | | |

Dimple Definitions

| | |
|---|---|
| Diameter: | Diameter of flat plane circumscribed by edge of dimple. |
| Depth: | Maximum depth of dimple from flat plane circumscribed by edge of dimple. |
| $V_0$: | Spatial volume of dimple below flat plane circumscribed by dimple edge, divided by volume of cylinder whose base is the flat plane and whose height is the maximum depth of dimple from the base. |
| SR: | Sum of individual dimple surface areas, each defined by the border of the flat plane circumscribed by the edge of the dimple, as a percentage of surface area of ball sphere were it to have no dimples thereon. |
| VR: | Sum of volumes of individual dimples formed below flat plane circumscribed by the edge of the dimple, as a percentage of volume of ball sphere were it to have no dimples thereon. |

The golf balls obtained in Examples 1 to 3 of the invention and Comparative Examples 1 to 7 had the internal construction, such as hardness and thickness, shown in Table 5 below.

TABLE 5

| | | Example | | | Comparative Example | | | | | | |
|---|---|---|---|---|---|---|---|---|---|---|---|
| | | 1 | 2 | 3 | 1 | 2 | 3 | 4 | 5 | 6 | 7 |
| Core | Diameter (mm) | 35.32 | 35.34 | 35.18 | 29.04 | 35.34 | 35.18 | 33.50 | 35.32 | 35.18 | 37.30 |
| | Weight (g) | 27.91 | 28.18 | 27.85 | 18.52 | 28.36 | 27.79 | 24.40 | 28.11 | 26.22 | 32.02 |
| | Specific gravity | 1.21 | 1.22 | 1.22 | 1.44 | 1.23 | 1.22 | 1.24 | 1.22 | 1.15 | 1.18 |
| | Deflection (mm) | 2.7 | 3.1 | 3.6 | 3.2 | 3.1 | 3.6 | 2.7 | 2.7 | 3.6 | 2.7 |
| | Surface hardness (D) | 58 | 56 | 53 | 54 | 56 | 53 | 58 | 58 | 53 | 58 |
| Envelope inside layer | Material | No. 1 | No. 1 | No. 1 | | | | | | | |
| | Thickness (mm) | 0.85 | 0.85 | 0.85 | | | | | | | |
| | Specific gravity | 0.93 | 0.93 | 0.93 | | | | | | | |
| | Material hardness (D) | 56 | 56 | 56 | | | | | | | |
| Sphere 1 | Outside diameter (mm) | 37.02 | 37.04 | 36.88 | | | | | | | |
| | Weight (g) | 31.16 | 31.43 | 31.08 | | | | | | | |
| Envelope outside layer | Material | No. 1 | No. 1 | No. 1 | No. 2 | No. 3 | No. 4 | No. 2 | No. 3 | Rubber formulation | |
| | Thickness (mm) | 0.86 | 0.85 | 0.91 | 4.08 | 1.71 | 1.76 | 1.50 | 1.34 | 1.79 | |
| | Specific gravity | 0.93 | 0.93 | 0.93 | 0.93 | 0.93 | 0.94 | 0.93 | 0.93 | 1.15 | |
| | Material hardness (D) | 60 | 60 | 60 | 56 | 51 | 63 | 56 | 56 | — | |
| Sphere 2 | Outside diameter (mm) | 38.74 | 38.75 | 38.71 | 37.20 | 38.75 | 38.71 | 36.50 | 38.00 | 38.75 | |
| | Weight (g) | 34.83 | 34.95 | 34.77 | 31.67 | 35.20 | 34.91 | 29.77 | 33.38 | 35.03 | |
| Intermediate layer | Material | No. 5 | No. 5 | No. 5 | No. 5 | No. 2 | No. 5 | No. 5 | No. 5 | No. 5 | No. 5 |
| | Thickness (mm) | 1.17 | 1.17 | 1.19 | 1.94 | 1.17 | 1.18 | 1.25 | 1.54 | 1.17 | 1.70 |
| | Specific gravity | 0.96 | 0.96 | 0.96 | 0.96 | 0.93 | 0.96 | 0.96 | 0.96 | 0.96 | 0.96 |
| | Material hardness (D) | 62 | 62 | 62 | 62 | 56 | 62 | 62 | 62 | 62 | 62 |
| Sphere 3 | Surface hardness (D) | 70 | 70 | 70 | 70 | 63 | 70 | 70 | 70 | 70 | 70 |
| | Outside diameter (mm) | 41.09 | 41.08 | 41.09 | 41.08 | 41.08 | 41.08 | 39.00 | 41.08 | 41.08 | 40.70 |
| | Weight (g) | 40.48 | 40.51 | 40.52 | 40.64 | 40.62 | 40.59 | 35.15 | 40.64 | 40.63 | 39.82 |
| Cover | Material | No. 6 | No. 6 | No. 6 | No. 6 | No. 7 | No. 6 | No. 6 | No. 6 | No. 6 | No. 6 |
| | Thickness (mm) | 0.82 | 0.82 | 0.82 | 0.82 | 0.82 | 0.82 | 1.86 | 0.82 | 0.82 | 1.00 |
| | Specific gravity | 1.07 | 1.08 | 1.06 | 1.07 | 1.07 | 1.07 | 1.07 | 1.07 | 1.07 | 1.07 |
| | Material hardness (D) | 48 | 48 | 48 | 48 | 58 | 48 | 48 | 48 | 48 | 48 |
| Ball | Surface hardness (D) | 64 | 64 | 64 | 64 | 68 | 64 | 64 | 64 | 64 | 64 |
| | Diameter (mm) | 42.73 | 42.72 | 42.72 | 42.72 | 42.72 | 42.72 | 42.72 | 42.72 | 42.72 | 42.70 |
| | Weight (g) | 45.28 | 45.32 | 45.27 | 45.33 | 45.30 | 45.28 | 45.42 | 45.32 | 45.31 | 45.50 |

Notes:
Sphere 1: Sphere composed of core encased by envelope inside layer.
Sphere 2: Sphere composed of core encased by envelope layer (including outside layer and inside layer).
Sphere 3: Sphere composed of Sphere 2 encased by intermediate layer.

(1) Core Deflection

The core was placed on a hard plate, and the deflection (mm) by the core when compressed under a final load of 1,275 N (130 kgf) from an initial load of 98 N (10 kgf) was measured.

(2) Surface Hardness (D) of Core

The surface of the core is spherical. The durometer indenter was set substantially perpendicular to this spherical surface, and Durometer D hardness measurements (using a type D durometer in accordance with ASTM-2240) were taken at two randomly selected points on the surface of the core. The average of the two measurements was used as the core surface hardness.

(3) Hardness (D) of Envelope Layer Materials (Including Inside Layer and Outside Layer)

The resin materials for the envelope layer were formed into sheets having a thickness of about 2 mm, and the hardnesses were measured with a type D durometer in accordance with ASTM-2240.

(4) Hardness (D) of Intermediate Layer Material

The same method of measurement was used as in (3) above.

(5) Surface Hardness (D) of Intermediate Layer-Covered Sphere (Sphere 3)

The durometer indenter was set substantially perpendicular to the spherical surface of the intermediate layer, and measurement was carried out in accordance with ASTM D2240.

(6) Hardness (D) of Cover Material

The same method of measurement was used as in (3) above.

(7) Surface Hardness (D) of Ball

The durometer indenter was set substantially perpendicular to a dimple-free area on the surface of the ball, and measurement was carried out in accordance with ASTM D2240.

The ball performances obtained for the golf balls in above Examples 1 to 3 according to the invention and in Comparative Examples 1 to 7 are shown below in Table 6.

TABLE 6

| | | | Example | | | Comparative Example | | | | | | |
|---|---|---|---|---|---|---|---|---|---|---|---|---|
| | | | 1 | 2 | 3 | 1 | 2 | 3 | 4 | 5 | 6 | 7 |
| Flight | W#1 HS, 45 m/s | Spin rate (rpm) | 3,277 | 3,100 | 3,057 | 3,315 | 3,025 | 2,986 | 3,452 | 3,373 | 3,112 | 3,357 |
| | | Carry (m) | 218.8 | 218.0 | 215.1 | 214.4 | 217.9 | 215.5 | 215.5 | 217.9 | 215.8 | 215.5 |
| | | Total distance (m) | 243.9 | 242.5 | 242.9 | 236.5 | 240.5 | 240.3 | 238.5 | 239.4 | 240.5 | 238.6 |

TABLE 6-continued

| | | Example | | | Comparative Example | | | | | | |
|---|---|---|---|---|---|---|---|---|---|---|---|
| | | 1 | 2 | 3 | 1 | 2 | 3 | 4 | 5 | 6 | 7 |
| | Rating | good | good | good | NG | good | good | NG | NG | good | NG |
| SW | Spin rate | 6,843 | 6,787 | 6,674 | 6,815 | 5,985 | 6,712 | 6,910 | 6,785 | 6,640 | 6,771 |
| HS, | (rpm) | | | | | | | | | | |
| 22 m/s | Rating | good | good | good | good | NG | good | good | good | good | good |
| Durability to repeated impact | Rating | good | good | good | good | good | NG | good | good | NG | good |
| Scuff resistance | Rating | good | good | good | good | NG | good | good | good | good | good |

The balls in each of the above examples were evaluated according to the following criteria (I) to (IV). All measurements were carried out in a 23° C. environment.

(I) Flight

The carry and total distance of the ball when hit at a head speed (HS) of 45 m/s with a club (BEAM Z model 430, manufactured by Bridgestone Sports Co., Ltd.; loft angle, 10.5°) mounted on a swing robot were measured. The results were rated according to the criteria indicated below. The spin rate was the value measured for the ball immediately following impact with an apparatus for measuring initial conditions.

Good: Total distance was 240 m or more

NG: Total distance was less than 240 m (II) Spin Rate on Approach Shots

The spin rate of a ball hit at a head speed (HS) of 22 m/s with a sand wedge (abbreviated below as "SW"; J's Classical Edition, manufactured by Bridgestone Sports Co., Ltd.) was measured. The results were rated according to the criteria indicated below. The spin rate was measured by the same method as that used above when measuring distance.

Good: Spin rate of 6,500 rpm or more

NG: Spin rate of less than 6,500 rpm (III) Durability to Repeated Impact

The ball was repeatedly hit at a head speed of 40 m/s with a W#1 club mounted on a golf swing robot. The number of shots that had been taken with the ball in Example 3 when the initial velocity fell below 97% of the average initial velocity for the first 10 shots was assigned a durability index of "100", and similarly obtained durability indices for the balls in the other examples were evaluated according to the following criteria. The average value for N=3 balls was used as the basis for evaluation in each example.

Good: Durability index was 90 or more

NG: Durability index was less than 90

(IV) Scuff Resistance

A non-plated pitching sand wedge was mounted on a swing robot, and the ball was hit once at a head speed of 40 m/s, following which the surface state of the ball was visually examined and rated as follows.

Good: Can be used again

NG: Cannot be used again

From the results in Table 6, the golf balls obtained in Comparative Examples 1 to 7 were inferior to the balls obtained according to the invention (Examples 1 to 3) in the following respects.

The ball in Comparative Example 1 was a four-piece golf ball which had an increased spin rate and a lower initial velocity, as a result of which an increased distance was not achieved.

The ball in Comparative Example 2 was a four-piece golf ball in which the cover serving as the outermost layer was formed so as to be hard. On approach shots, the ball was not very receptive to spin, in addition to which it had a poor scuff resistance.

The ball in Comparative Example 3 was a four piece golf ball having an envelope layer formed so as to be harder than the intermediate layer. The ball had a poor durability to cracking on repeated impact.

The ball in Comparative Example 4 was a four-piece golf ball in which the cover serving as the outermost layer was thick. The ball had a high spin rate, as a result of which an increased distance was not achieved.

The ball in Comparative Example 5 was a four-piece golf ball in which the envelope layer was thinner than the intermediate layer. The ball lacked a sufficient spin rate-lowering effect on full shots, as a result of which an increased distance was not achieved.

The ball in Comparative Example 6 was a four-piece golf ball in which the envelope layer was made of rubber. The ball had a poor durability to cracking on repeated impact.

The ball in Comparative Example 7 was a so-called three-piece golf ball which was composed of a core encased by two layers and which lacked an envelope layer. The ball retained a high spin rate, as a result of which an increased distance was not achieved.

The invention claimed is:

1. A multi-piece solid golf ball comprising a core, an envelope layer which encases the core and comprises an inside layer and an outside layer, an intermediate layer encasing the envelope layer, and a cover which encases the intermediate layer and has formed on a surface thereof a plurality of dimples, wherein the core is formed primarily of a rubber material, the envelope layer, intermediate layer and cover are each formed primarily of the same or different resin materials; the envelope layer, intermediate layer and cover have thicknesses which satisfy the relationship:

cover thickness<intermediate layer thickness<envelope layer total thickness;

the envelope layer, intermediate layer and cover have material hardnesses (Durometer D hardness) which satisfy the relationship:

hardness of envelope inside layer material<hardness of envelope outside layer material<hardness of intermediate layer material>hardness of cover material;

the envelope outside layer material has a Durometer D hardness of at least 53;

the surface hardness of the golf ball is made softer than the surface hardness of the intermediate layer by an amount within a Durometer D hardness range of 1 to 10; and the value $V_0$ obtained by dividing the spatial volume of each dimple below the flat plane circumscribed by the edge of that dimple by the volume of a cylinder whose base is the flat plane and whose height from the base to the maximum depth of the dimple is at least 0.35 but not more than 0.80.

2. The multi-piece solid golf ball of claim 1, wherein the resin material of the envelope inside layer and/or the envelope outside layer is a material comprising, in admixture:

a base resin of (a) an olefin-unsaturated carboxylic acid random copolymer and/or a metal ion neutralization product of an olefin-unsaturated carboxylic acid random copolymer mixed with (b) an olefin-unsaturated carboxylic acid-unsaturated carboxylic acid ester ternary random copolymer and/or a metal ion neutralization product of an olefin-unsaturated carboxylic acid-unsaturated carboxylic acid ester ternary random copolymer in a weight ratio between 100:0 and 0:100, and (e) a non-ionomeric thermoplastic elastomer in a weight ratio between 100:0 and 50:50.

3. The multi-piece solid golf ball of claim 1, wherein the resin material of the envelope inside layer and/or the envelope outside layer is a material comprising:

100 parts by weight of a resin component composed of, in admixture, a base resin of (a) an olefin-unsaturated carboxylic acid random copolymer and/or a metal ion neutralization product of an olefin-unsaturated carboxylic acid random copolymer mixed with (b) an olefin-unsaturated carboxylic acid-unsaturated carboxylic acid ester ternary random copolymer and/or a metal ion neutralization product of an olefin-unsaturated carboxylic acid-unsaturated carboxylic acid ester ternary random copolymer in a weight ratio between 100:0 and 0:100, and (e) a non-ionomeric thermoplastic elastomer in a weight ratio between 100:0 and 50:50;

(c) 5 to 80 parts by weight of a fatty acid and/or fatty acid derivative having a molecular weight of 228 to 1500; and (d) 0.1 to 10 parts by weight of a basic inorganic metal compound capable of neutralizing un-neutralized acid groups in the base resin and component (c).

4. The multi-piece solid golf ball of claim 1, wherein the resin material of the outermost layer cover is a material composed primarily of a heated mixture of:

(A) a thermoplastic polyurethane material, and (B) an isocyanate mixture of (b-1) an isocyanate compound having at least two isocyanate groups as functional groups per molecule, dispersed in (b-2) a thermoplastic resin which is substantially non-reactive with isocyanate.

5. The multi-piece solid golf ball of claim 1, wherein the hardness of the envelope inside layer is made lower than that of the envelope outside layer by an amount within a Durometer D hardness range of 1 to 10.

6. The multi-piece solid golf ball of claim 1, wherein the envelope outside layer is formed so as to be softer than the intermediate layer by an amount within a Durometer D hardness range of 1 to 10.

7. The multi-piece solid golf ball of claim 1, wherein the thickness of the cover is at least 0.3 mm but not more than 1.2 mm.

8. The multi-piece solid golf ball of claim 1, wherein the surface hardness of the ball is at least 55 but not more than 70 in terms of the Durometer D hardness.

9. The multi-piece solid golf ball of claim 1, wherein the numbers of the dimples arranged on the cover surface is at least 280 but not more than 360.

10. The multi-piece solid golf ball of claim 1, wherein the diameter of the dimples is set to at least about 2.5 mm but not more than about 6.5 mm.

11. The multi-piece solid golf ball of claim 1, wherein the dimple coverage on the spherical surface of the golf ball, which is the sum of the individual dimple surface areas, each defined by the border of the flat plane circumscribed by the edge of the dimple, expressed as a ratio (SR) with respect to the spherical surface area of the ball were it to be free of dimples, is at least 60% but not more than 90%.

12. The multi-piece solid golf ball of claim 1, wherein the VR value, which is the sum of the volumes of individual dimples formed below flat planes circumscribed by the dimple edges, as a percentage of the volume of the ball sphere were it to have no dimples thereon, is at least 0.6% but not more than 1.0%.

13. A multi-piece solid golf ball comprising a core, an envelope layer which encases the core and comprises an inside layer and an outside layer, an intermediate layer encasing the envelope layer, and a cover which encases the intermediate layer and has formed on a surface thereof a plurality of dimples, wherein the core is formed primarily of a rubber material, the envelope layer, intermediate layer and cover are each formed primarily of the same or different resin materials; the envelope layer, intermediate layer and cover have thicknesses which satisfy the relationship:

cover thickness<intermediate layer thickness<envelope layer total thickness;

the envelope layer, intermediate layer and cover have material hardnesses (Durometer D hardness) which satisfy the relationship:

hardness of envelope inside layer material<hardness of envelope outside layer material<hardness of intermediate layer material>hardness of cover material;

the envelope outside layer material has a Durometer D hardness of at least 53;

the surface hardness of the golf ball is made softer than the surface hardness of the intermediate layer by an amount within a Durometer D hardness range of 1 to 10; and the VR value, which is the sum of the volumes of individual dimples formed below flat planes circumscribed by the dimple edges, as a percentage of the volume of the ball sphere were it to have no dimples thereon, is at least 0.6% but not more than 1.0%.

14. The multi-piece solid golf ball of claim 13, wherein the resin material of the envelope inside layer and/or the envelope outside layer is a material comprising, in admixture:

a base resin of (a) an olefin-unsaturated carboxylic acid random copolymer and/or a metal ion neutralization product of an olefin-unsaturated carboxylic acid random copolymer mixed with (b) an olefin-unsaturated carboxylic acid-unsaturated carboxylic acid ester ternary random copolymer and/or a metal ion neutralization product of an olefin-unsaturated carboxylic acid-unsaturated carboxylic acid ester ternary random copolymer in a weight ratio between 100:0 and 0:100, and (e) a non-ionomeric thermoplastic elastomer in a weight ratio between 100:0 and 50:50.

15. The multi-piece solid golf ball of claim 13, wherein the resin material of the envelope inside layer and/or the envelope outside layer is a material comprising:

100 parts by weight of a resin component composed of, in admixture, a base resin of (a) an olefin-unsaturated carboxylic acid random copolymer and/or a metal ion neutralization product of an olefin-unsaturated carboxylic acid random copolymer mixed with (b) an olefin-unsaturated carboxylic acid-unsaturated carboxylic acid ester ternary random copolymer and/or a metal ion neutralization product of an olefin-unsaturated carboxylic acid-unsaturated carboxylic acid ester ternary random copolymer in a weight ratio between 100:0 and 0:100, and (e) a non-ionomeric thermoplastic elastomer in a weight ratio between 100:0 and 50:50;

(c) 5 to 80 parts by weight of a fatty acid and/or fatty acid derivative having a molecular weight of 228 to 1500; and (d) 0.1 to 10 parts by weight of a basic inorganic metal compound capable of neutralizing un-neutralized acid groups in the base resin and component (c).

16. The multi-piece solid golf ball of claim 13, wherein the resin material of the outermost layer cover is a material composed primarily of a heated mixture of:

(A) a thermoplastic polyurethane material, and (B) an isocyanate mixture of (b-1) an isocyanate compound having at least two isocyanate groups as functional groups per molecule, dispersed in (b-2) a thermoplastic resin which is substantially non-reactive with isocyanate.

17. The multi-piece solid golf ball of claim 13, wherein the hardness of the envelope inside layer is made lower than that of the envelope outside layer by an amount within a Durometer D hardness range of 1 to 10.

18. The multi-piece solid golf ball of claim 13, wherein the envelope outside layer is formed so as to be softer than the intermediate layer by an amount within a Durometer D hardness range of 1 to 10.

19. The multi-piece solid golf ball of claim 13, wherein the thickness of the cover is at least 0.3 mm but not more than 1.2 mm.

20. The multi-piece solid golf ball of claim 13, wherein the surface hardness of the ball is at least 55 but not more than 70 in terms of the Durometer D hardness.

21. The multi-piece solid golf ball of claim 13, wherein the numbers of the dimples arranged on the cover surface is at least 280 but not more than 360.

22. The multi-piece solid golf ball of claim 13, wherein the diameter of the dimples is set to at least about 2.5 mm but not more than about 6.5 mm.

23. The multi-piece solid golf ball of claim 13, wherein the dimple coverage on the spherical surface of the golf ball, which is the sum of the individual dimple surface areas, each defined by the border of the flat plane circumscribed by the edge of the dimple, expressed as a ratio (SR) with respect to the spherical surface area of the ball were it to be free of dimples, is at least 60% but not more than 90%.

* * * * *